United States Patent [19]

Williams, III

[11] Patent Number: 4,541,639

[45] Date of Patent: Sep. 17, 1985

[54] RAM-TYPE BLOWOUT PREVENTER WITH IMPROVED RAM FRONT PACKER

[75] Inventor: Bolie C. Williams, III, Houston, Tex.

[73] Assignee: Cameron Iron Works, Inc., Houston, Tex.

[21] Appl. No.: 419,080

[22] Filed: Sep. 16, 1982

[51] Int. Cl.[4] ..... F16J 15/56; E21B 33/06

[52] U.S. Cl. ..... 277/73; 277/127; 277/198; 277/199; 251/1.3

[58] Field of Search ..... 251/1 A, 1 R, 1 B; 277/31, 198, 199, 231, 30, 73, 165, 166, 127, 192, 228; 384/138, 273, 296

[56] References Cited

U.S. PATENT DOCUMENTS

| | | | |
|---|---|---|---|
| 1,466,137 | 8/1923 | Mead | 384/296 X |
| 2,194,255 | 3/1940 | Allen | 277/73 |
| 2,912,214 | 11/1959 | Allen et al. | 251/1 A |
| 3,692,316 | 9/1972 | Bishop et al. | 277/199 |
| 4,332,367 | 6/1982 | Nelson | 251/1 A |
| 4,398,729 | 8/1983 | Bishop et al. | 251/1 A |

FOREIGN PATENT DOCUMENTS

| | | | |
|---|---|---|---|
| 594175 | 3/1960 | Canada | 251/1 A |
| 681312 | 10/1952 | United Kingdom | 277/165 |

*Primary Examiner*—Robert S. Ward
*Attorney, Agent, or Firm*—Vinson & Elkins

[57] ABSTRACT

A ram-type blowout preventer having a body with a central bore extending therethrough and with guideways extending outward from the central bore, a ram in each of the guideways and having a recess on its front face, a front packer positioned in said ram recess and including a backing portion and an insert portion, the insert portion being tightly inter-engaged with said backing portion.

8 Claims, 9 Drawing Figures

RAM-TYPE BLOWOUT PREVENTER WITH IMPROVED RAM FRONT PACKER

BACKGROUND

Blowout preventers have long been used in maintaining control of oil and gas wells during drilling. Usually several units are used in one stack. This allows blind rams and different size pipe rams to be available in a single stack. After many uses under pressure blind rams and pipe rams may require that the front packings be changed.

Most pipe rams are now designed to seal on one specific size of drill pipe, tubing, or casing. When drilling conditions require changing pipe sizes, e.g., from a 4 inch to a 3½ inch drill pipe, standard procedure now is to change the complete set of pipe rams, or change the complete front packings.

Prior blowout preventers have utilized front packings which are removable from the ram. This allows the ram to be used in a variety of applications. In most cases the major portion of the front packing is undamaged but the entire packing is replaced whenever its central pipe sealing portion is damaged.

In prior stripping rams, an arcuate insert of reduced friction material has been used between the upper and lower plates to line the pipe receiving recess. A structure of this type is shown in U.S. Pat. No. 4,323,256.

Another type of insert used in the front face of a ram front packer is the resilient retainer which defines a part of a groove into which a plastic sealant is injected as shown in U.S. Pat. No. 4,227,543.

SUMMARY

The present invention relates to an improved ram-type blowout preventer in which the ram front packing includes a backing portion and a replaceable face sealing or insert portion which are inter-engageable with each other so that when installed in the ram packer slot they are held together.

An object of the present invention is to provide an improved ram-type blowout preventer which can be used as a blind ram blowout preventer or as a pipe ram blowout preventer for different pipe sizes without the expense of carrying a complete stock of ram front packers.

Another object is to provide an improved ram front packer for a ram-type blowout preventer which after wear or damage can be inexpensively replaced.

A further object is to provide an improved ram front packer for a ram-type blowout preventer allowing an improved seal without sacrificing the strength and integrity of the front packer.

BRIEF DESCRIPTION OF THE DRAWINGS

These and other objects and advantages of the present invention are hereinafter set forth and explained with respect to the drawings wherein.

DESCRIPTION OF THE PREFERRED EMBODIMENT

Figure 1:
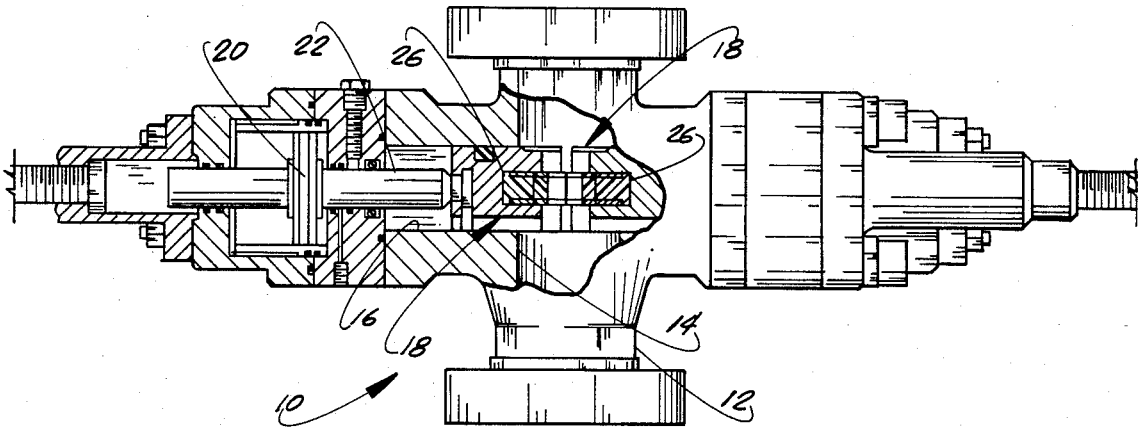
FIG. 1 is an elevation view partly in section of the improved ram-type blowout preventer of the present invention.
Figure 2:
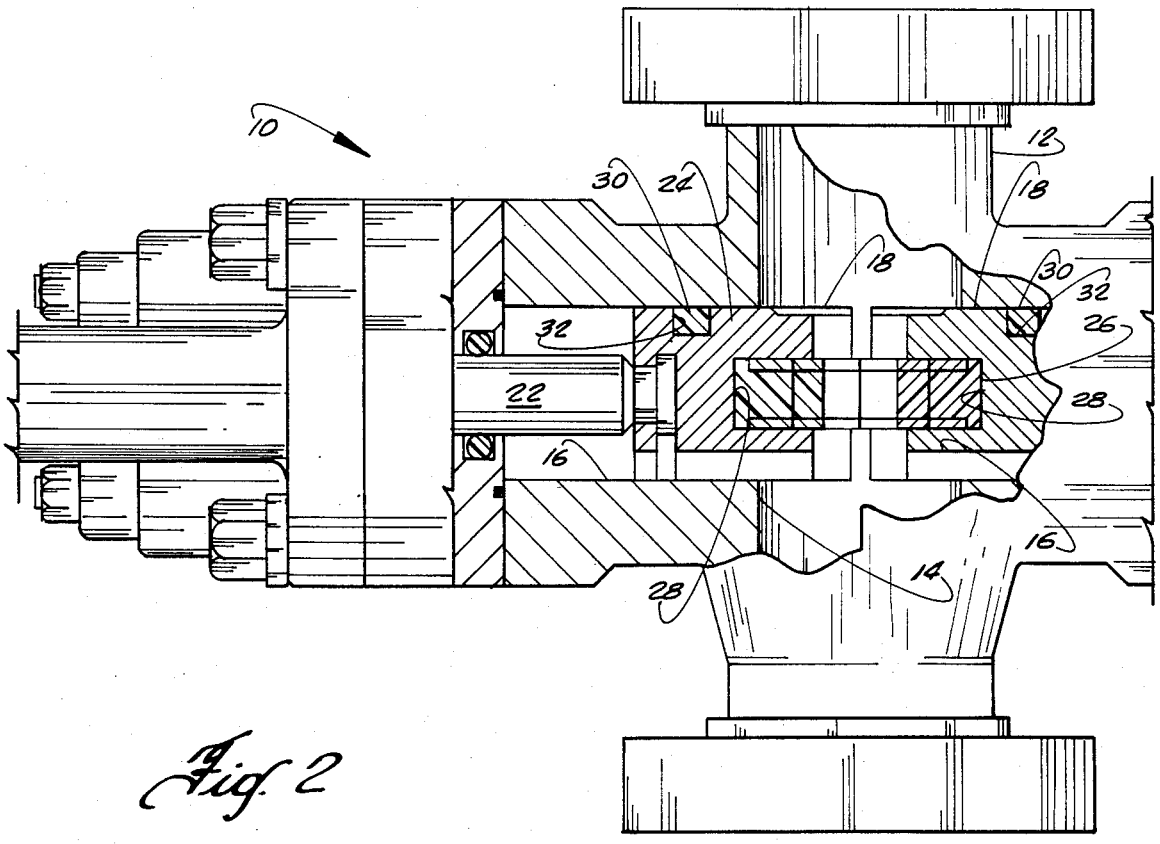
FIG. 2 is an enlarged view, partly in section, of one side of the blowout preventer shown in FIG. 1.
Figure 5:
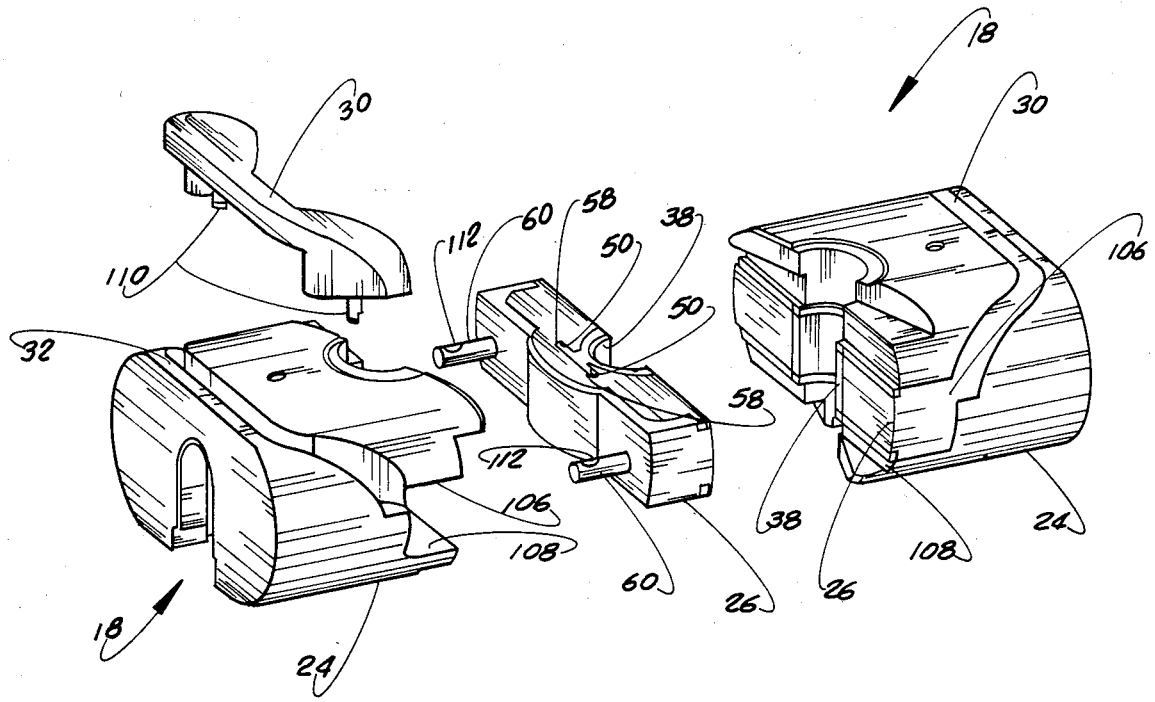
FIG. 5 is an exploded view of the complete ram assembly of the improved blowout preventer.

Blowout preventer 10 is shown having body 12 through which central bore 14 extends with opposed aligned guideways 16 extending outward from bore 14 as shown in FIGS. 1 and 2. Ram 18 is moved in guideway 16 by suitable actuator 20 connected to ram 18 by connecting rod 22. Ram 18 includes body 24, ram front packing 26 positioned in front recess 28 and packing seal 30 which is positioned in a groove 32 in body 24 that extends along the sides and across the top of body 24 and seal 30 seals against ram front packing 26 as shown in FIG. 5 and seals against the interior of the guideway 16.

Figure 3:
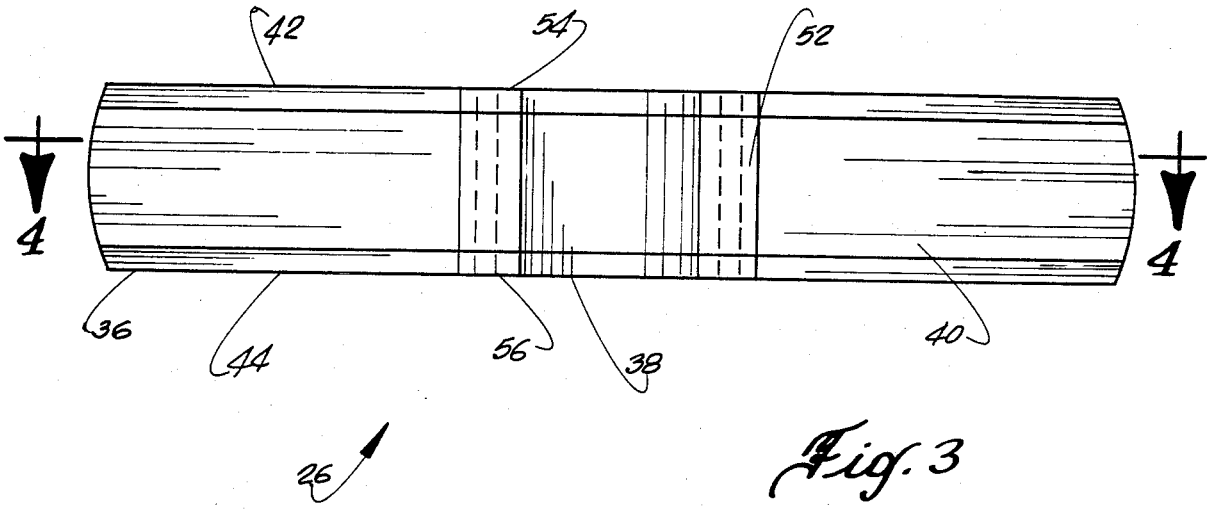
FIG. 3 is a front elevation view of the ram front packing of the improved blowout preventer of the present invention.
Figure 4:
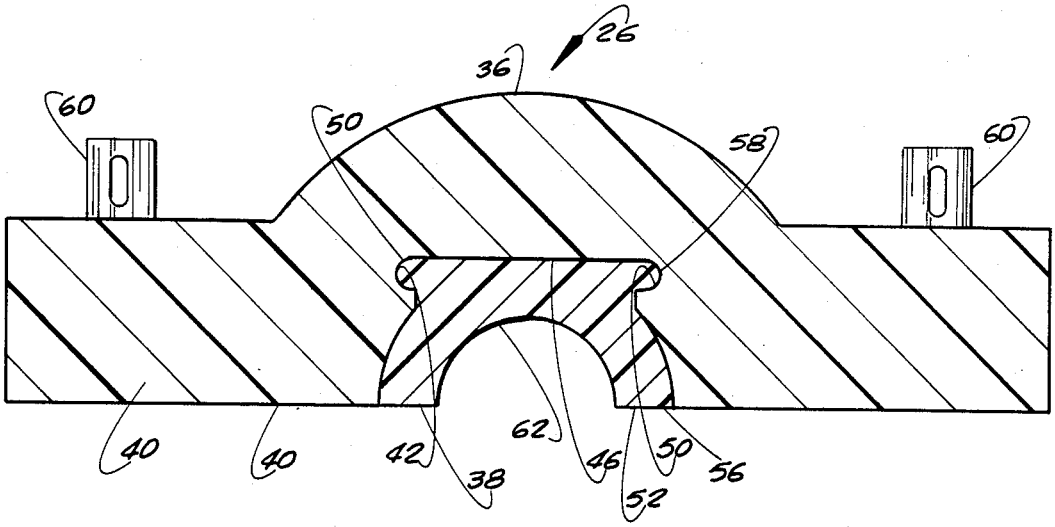
FIG. 4 is a sectional view of the improved ram front packing taken along line 4—4 in FIG. 3.

Ram front packing 26 is best seen in FIGS. 3 and 4 and includes backing portion 36 and replaceable insert portion 38. Backing portion 36 includes elastomeric material or body 40 with upper and lower reinforcing plates 42 and 44 bonded thereto or integrally formed therein. Backing portion 36 includes recess 46 in its forward face 48. Recess 46 includes re-entrant portions 50. Insert portion 38 includes elastomeric material or body 52 with upper and lower retaining plates 54 and 56 bonded thereto or integrally formed therein. In plan view insert portion 38 has a shape which fits closely into recess 46 with lips 58 fitting closely into re-entrant portions 50 of recess 46. Retaining plates 54 and 56 are substantially flush with reinforcing plates 42 and 44. Lugs 60 extend from the rear of packing 26 and are used to secure packing 26 into recess 28 in ram 18. Insert portion 38 includes pipe receiving recess 62 of a preselected size in its front face 64. If desired recess 62 may be omitted if packer 26 is to be in the form of a blind ram.

With insert 38 positioned in engagement with recess 46 in backing portion 36 and packer 26 secured in recess 28, packer 26 functions as other ram packers with several advantages not present in other packers. Simply by changing insert 38, front packer 26 can be used as a packer for a blind ram or a pipe ram in a variety of sizes. Also since most of the wear in a pipe ram is in the portion engaging the pipe, particularly in stripping operations, the replacement of insert 38 provides a substantially new ram front packer insert for a fraction of the cost of an entire ram front packer. Additionally different hardness of elastomeric materials can be used in backing portion 36 and in insert portion 38 to allow better sealing against pipe without sacrificing the strength and integrity of the packer. Additionally in stripping operations body 52 of insert 38 may be made of a low coefficient of friction material such as Teflon as manufactured by DuPont Company.

Figure 6:
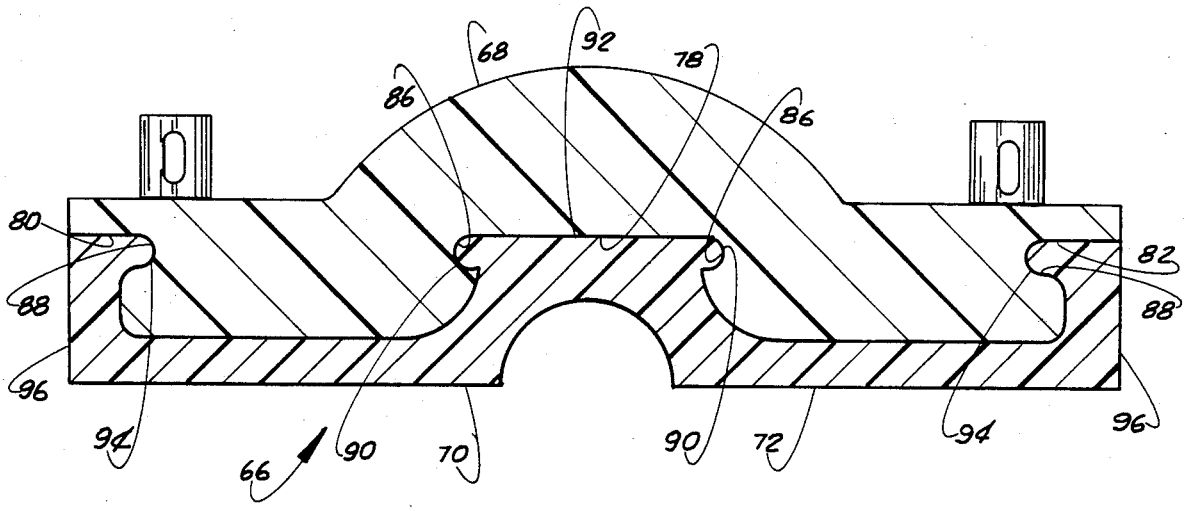
FIG. 6 is a sectional view of another embodiment of the improved ram front packing.
Figure 7:
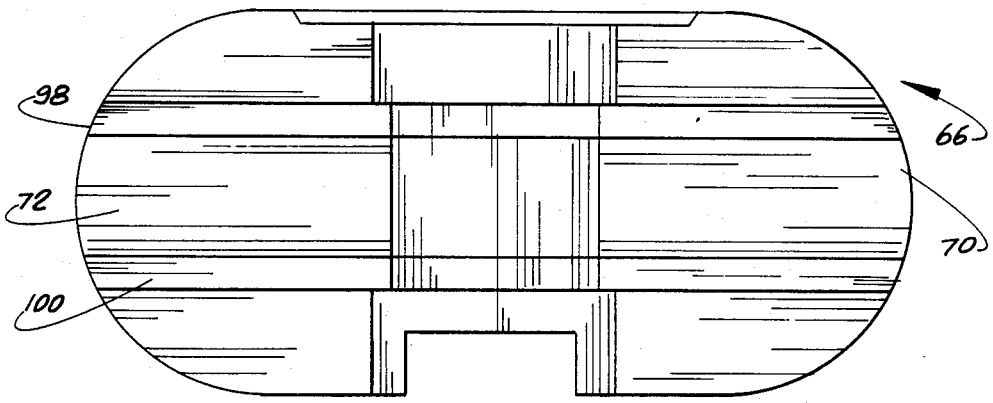
FIG. 7 is a front view of the ram of the improved blowout preventer with the packing of FIG. 6 installed.

An alternate form of ram front packer is packer 66 as shown in FIGS. 6 and 7. Packer 66 includes backing portion 68 and replaceable insert portion 70. Insert 70 traverses essentially the entire front of packer 66 and includes elastomeric material or body 72 with upper and lower retaining plates 98 and 100 bonded thereto or integrally formed therein. Backing portion 68 includes central recess 78, side recesses 80, and 82. Central recess 78 is formed in the forward face 84. Recess 78 includes re-entrant portion 86 and side recesses 80 and 82 include re-entrant portions 88. In sectional view, as shown in FIG. 6, insert portion 70 has a shape which fits closely into central recess 78, side recesses 80 and 82 of backing portion 68 with lips 90 of central portion 92 and lips 94 of side portions 96 fitting closely into re-entrant portions 86 and 88, respectively. Retaining plates 98 and 100 of insert portion 70 are substantially flush with the reinforcing plates of backing portion 68. It is to be understood that packer 66 is similar to packer 26 except as described above.

As shown in FIG. 5, when installed in ram body 24 ram front packer 26 and insert 38 are retained against vertical movement by upper and lower portions 106 and 108 of ram body 24. Pins 110 of packing seal 30 insert into slots 112 of lugs 60 to retain ram front packer 26 against forward movement. Insert 38 is retained against forward movement by lips 58 fitting closely into re-entrant portion 50.

Figure 8:
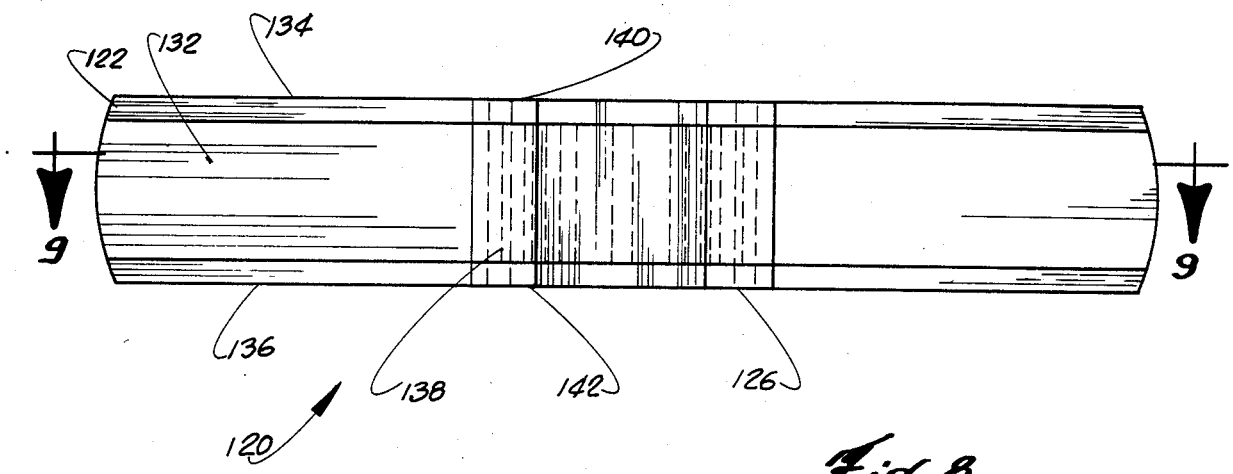
FIG. 8 is a front elevation view of another modified form of the improved ram front packing of the present invention.
Figure 9:
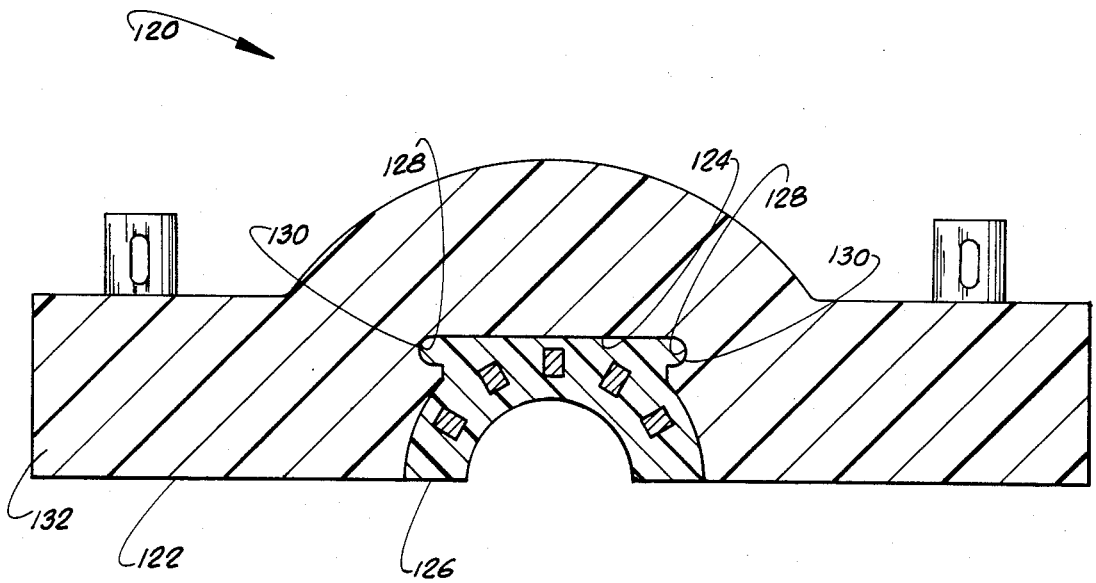
FIG. 9 is a sectional view taken along line 9—9 in FIG. 8.

A modified form of the improved ram front packer of the present invention is shown in FIGS. 8 and 9 as packer 120 which includes backing portion 122 with face recess 124 and insert portions 126. Backing portion 122 is substantially the same as backing portion 36. Face recess 124 has re-entrant portions 128 and lips 130 of insert portion 126 fit tightly therein. Backing portion 122 includes elastomeric body 132 and upper and lower plates 134 and 136. Insert portion 126 includes elastomeric body 138 with upper and lower plates 140 and 142 which are spaced apart by stems 144. Stems 144 are secured to plates 140 and 142. Stems 144 provide additional stability to insert 126 when its inner surface is spaced substantially inward from the forward portions 106 and 108 of ram body 24. Also if it is desired to close the rams and support a string thereon it is preferable that packer 120 be used so that additional support strength is available to support the string.

What is claimed is:

1. A ram-type blowout preventer comprising a body having a central bore therethrough and aligned guideways extending outward from the central bore, a ram in each of said guideways and having a front recess, a front packer positioned in said ram front recess, said front packer including an elastomeric backing portion having a recess in its front face and an elastomeric insert portion removably positioned in said recess of said backing portion, said recess in said backing portion including re-entrant recesses at each side of the rear of the recess, and said insert portion having lips which fit tightly into said re-entrant portions of said recess.

2. A ram-type blowout preventer according to claim 1 wherein said insert portion includes a body of elastomeric material, an upper plate and a lower plate.

3. A ram-type blowout preventer according to claim 1 wherein said backing portion includes a body of elastomeric material, an upper plate and a lower plate.

4. A ram-type blowout preventer according to claim 1 wherein said backing portion includes elastomeric material with upper and lower plates bonded thereto, said insert portion includes elastomeric material with upper and lower plates bonded thereto, and the elastomeric material in said backing portion is different than the elastomeric material in said insert portion.

5. A ram-type blowout preventer according to claim 1 wherein said insert portion of said front packer has a pipe receiving recess on its front face.

6. A front packing for a ram-type blowout preventer comprising a backing portion of elastomeric material with an upper plate and a lower plate, and an insert portion of elastomeric material with an upper plate and a lower plate, said backing portion having a recess in its front face with re-entrant recesses at each side thereof, said insert portion having a shape to tightly interengage in said backing portion recess and including lips adapted to tightly fit into said re-entrant recesses.

7. A front packing according to claim 6 wherein said insert portion has a pipe receiving recess on its front face.

8. A ram-type blowout preventer comprising a body having a central bore therethrough and aligned guideways extending outward from the central bore, a ram in each of said guideways and having a front recess, a front packer positioned in said ram front recess, said front packer including an elastomeric backing portion having a recess in its front face and side recesses and an elastomeric insert portion removably positioned in said recess of said backing portion, said insert portion extending across the face of said backing portion and having side portions fitting closely into said backing portion side recesses.

* * * * *

UNITED STATES PATENT AND TRADEMARK OFFICE

CERTIFICATE OF CORRECTION

PATENT NO. : 4,541,639

DATED : September 17, 1985

INVENTOR(S) : Bolie C. Williams, III.

It is certified that error appears in the above—identified patent and that said Letters Patent is hereby corrected as shown below:

Column 3, line 26, change "portion" to -- portions --.

Column 4, lines 37 and 38, change "recesses" to -- recess --.

Signed and Sealed this

*Seventh* Day of *January 1986*

[SEAL]

*Attest:*

DONALD J. QUIGG

*Attesting Officer*

*Commissioner of Patents and Trademarks*